US007096927B2

(12) United States Patent
Nitta

(10) Patent No.: US 7,096,927 B2
(45) Date of Patent: Aug. 29, 2006

(54) TWO-PIECE RADIATOR/CONDENSER PIN ASSEMBLY

(75) Inventor: Minoru Nitta, Upland, CA (US)

(73) Assignee: Newfield Technology Corporation, Upland, CA (US)

( * ) Notice: Subject to any disclaimer, the term of this patent is extended or adjusted under 35 U.S.C. 154(b) by 154 days.

(21) Appl. No.: 10/618,065

(22) Filed: Jul. 11, 2003

(65) Prior Publication Data

US 2005/0006051 A1 Jan. 13, 2005

(51) Int. Cl.
*F28F 9/007* (2006.01)

(52) U.S. Cl. ..... 165/67; 180/68.4

(58) Field of Classification Search ..... 165/67; 180/68.4

See application file for complete search history.

(56) References Cited

U.S. PATENT DOCUMENTS 3,929,201 A * 12/1975 Hoffman ..... 180/68.4
4,579,184 A * 4/1986 Hiramoto ..... 180/68.4
4,651,839 A * 3/1987 Isobe ..... 180/68.4
4,770,234 A * 9/1988 Hiraoka et al. ..... 165/69
4,858,866 A * 8/1989 Werner ..... 248/213.3
5,544,714 A * 8/1996 May et al. ..... 180/68.4
6,000,460 A * 12/1999 Yamanaka et al. ..... 165/67
6,237,676 B1 * 5/2001 Hasegawa et al. ..... 165/67

FOREIGN PATENT DOCUMENTS

JP 2003106787 A * 4/2003

* cited by examiner

*Primary Examiner*—Allen J. Flanigan
(74) *Attorney, Agent, or Firm*—Pillsbury Winthrop Shaw Pittman LLP

(57) ABSTRACT

A pin for a cooling system includes an inner layer formed of a first metal. The inner layer is hollow, and is coupled to a header of the cooling system. An outer layer is formed of a second metal, and the outer layer is coupled to the inner layer via a coupling material.

16 Claims, 6 Drawing Sheets

TWO-PIECE RADIATOR/CONDENSER PIN ASSEMBLY

BACKGROUND OF THE INVENTION

1. Field of the Invention

The present invention relates generally to a radiator/condenser pin assembly for an automobile.

2. Discussion of the Related Art

A radiator/condenser, in its assembled form, is held in place within an automobile's engine compartment by radiator/condenser pins. These pins are typically positioned in a vertical fashion near the (a) left-hand side of the top edge, (b) the left-hand side of the bottom edge, (c) the right-hand side of the top edge, and (d) the right-hand side of the bottom edge. The pins are usually manufactured from a plastic resin or a solid piece of metal.

Designs utilizing a plastic resin are problematic, however. Many jurisdictions have strict recycling laws regarding automobiles that are out of commission. In jurisdictions where an automobile's radiator/condenser must be recycled for raw materials, radiators/condensers having plastics resin pins must first have the plastic resin pins manually removed before the radiator/condenser can be recycled, resulting in an extra recycling expense.

Also, pins formed of a plastic resin are typically not as strong as pins formed of a metal. Recent trends within the automobile industry are toward enhancing ease of assembly. In the case of air conditioning units for automobiles, a condenser, a radiator, and receiver tanks are routinely combined together to form a single module. When multiple parts are combined together to form a module, the weight of the module often becomes quite heavy. However, in a given application, plastic resin pins can be insufficient to support the weight of the module.

Other applications in the art utilize radiator/condenser pins formed of a solid piece of metal. This solid piece of metal is typically formed via a cold forging process or via a machining process from a solid piece of metal. However, use of a solid piece of metal, such as aluminum, can add great expense to the cost of the pin. Also, the solid piece of metal adds a large amount of extra weight to the automobile, adversely affecting the automobile's fuel efficiency. In either case, if either a cold forging process or machining process is utilized, the pin cannot be formed from a cladded material. Accordingly, an additional process of applying brazing paste or a brazing sheet to the part prior to a brazing process is required.

For applications utilizing a pin formed of a single piece of metal, the shape of the pin is usually carved from a larger piece of material via a machining process, which can be a complicated and time-intensive process. Also, when solid pins are utilized, the material utilized to manufacture solid pins cannot be pre-coated with a cladding material to secure the solid pins to the radiator/condenser, because a cladding material typically cannot be used with a solid piece of metal material, and can only be used with sheet metal. Moreover, the solid pin typically affects the quality of the part when assembled onto a larger component. After the entire radiator/condenser assembly is assembled, the assembly is put through a brazing furnace to melt the clad material, thus brazing together individual components of the radiator/condenser assembly via the brazing process. In the brazing process, heat is applied to the entire radiator/condenser, with the objective of melting only the clad material and not the base material. If a certain area being brazed has a greater thickness than the rest of the radiator/condenser, that specific location takes longer time to heat up. Also, the extra mass requires extra heat to become hot enough to reach the material melt temperature. Conversely, if a certain area being brazed is thinner, then that particular location takes less time to reach the optimum temperature to melt the clad material. Since it takes less time to heat up lower mass areas, there is a potential to overheat the section, potentially melting not only the clad material but also the base material, resulting in destruction of the section during the brazing process.

Accordingly, when solid pins are utilized, extra energy must be expended during the brazing process. Since solid pins are typically thicker than the remainder of the radiator/condenser, more heat must be added to the entire assembly to ensure the radiator/condenser pins are properly brazed. As a result, more cost is expended to maintain higher furnace temperature. Also, the radiator/condenser assembly is typically on a conveyor belt during this brazing process and the furnace typically is heated to a set temperature. To ensure the solid pins are properly brazed, the speed of the conveyor must be slowed. As a consequence, the time required to properly braze the assembly is increased, resulting in a lower throughput than would be required if the solid pins had thicknesses similar to the rest of the radiator/condenser assemblies. Such solid pin assemblies are also deficient because, due to their solid designs, they cannot simultaneously serve as both a radiator/condenser pin and an end cap for a radiator/condenser manifold. End caps are caps that attach to both ends of a radiator/condenser manifold, since radiator/condenser manifolds are typically hollow pieces-similar to pipes.

Furthermore, designs in the current art provide only one brazing surface for brazing a radiator/condenser pin to a radiator/condenser header. FIG. 6 illustrates a pin 600 brazed to a radiator/condenser tube header 605 according to the prior art. As shown, the pin 600 is brazed onto the header 605 only on the outside edge of the header 605. The pin 600 is not brazed at the top of the header 605. Accordingly, the pin 600 is susceptible to becoming detached from the header 605 because only one surface of the header 605 is brazed to the pin 600.

Accordingly, plastic radiator/condenser pin assemblies are deficient because those made of a plastic resin make recycling more difficult and are insufficiently strong for heavy radiator/condenser assemblies and cannot also be used as an end cap. Solid metal pins are deficient because they are expensive, heavy, more difficult to machine and braze, cannot be used with a clad material, and cannot also be used as an end cap, without additional components or extensive part processing.

DETAILED DESCRIPTION

According to an embodiment of the invention, a radiator pin may be formed for a radiator from two pieces of metal. (An embodiment of the pin described below may be used in, for example, both condensers and radiators. However, for purposes of simplicity, only the radiator embodiment is described in detail below. But the teachings with respect to the radiator are equally applicable to an embodiment utilizing a condenser.)

The radiator pin may be formed of two pieces of a metal, such as aluminum layered with a clad material, and both pieces may be hollow. An inner layer of the pin may be formed of aluminum and coated with a clad material on its outside and/or inside. An outer layer may also be formed of aluminum and coated with the clad material on its inside and/or outside. The inner layer may serve to seal the surface of the radiator header (i.e., act as a radiator cap). The outer layer may serve to couple the radiator to the inside of an automobile, or other system utilizing a radiator having radiator pins. The outer layer may also serve a secondary function of providing an additional sealing surface for the radiator header.

The inner layer may be physically placed within the outer layer. If the outer side of the inner layer is coated with a clad material, and/or the inner side of the outer layer is coated with the clad material, the inner layer may become physically coupled to the outer layer during the brazing process.

The radiator may be formed from a sheet metal that is already layered with clad material to a base material. The clad-layered sheet metal looks like an ordinary sheet metal, but in reality, clad material, is fused together to the base material to form a single sheet metal. The clad material may be an aluminum alloy having a lower melting temperature than the base material. The base material may be an aluminum alloy having a melting temperature higher than that of the clad material. This type of cladded/base material is only available in sheet metal form, and not as a solid piece of aluminum (also known as aluminum ingot) that is typically used in cold forging or machining process.

Figure 1:
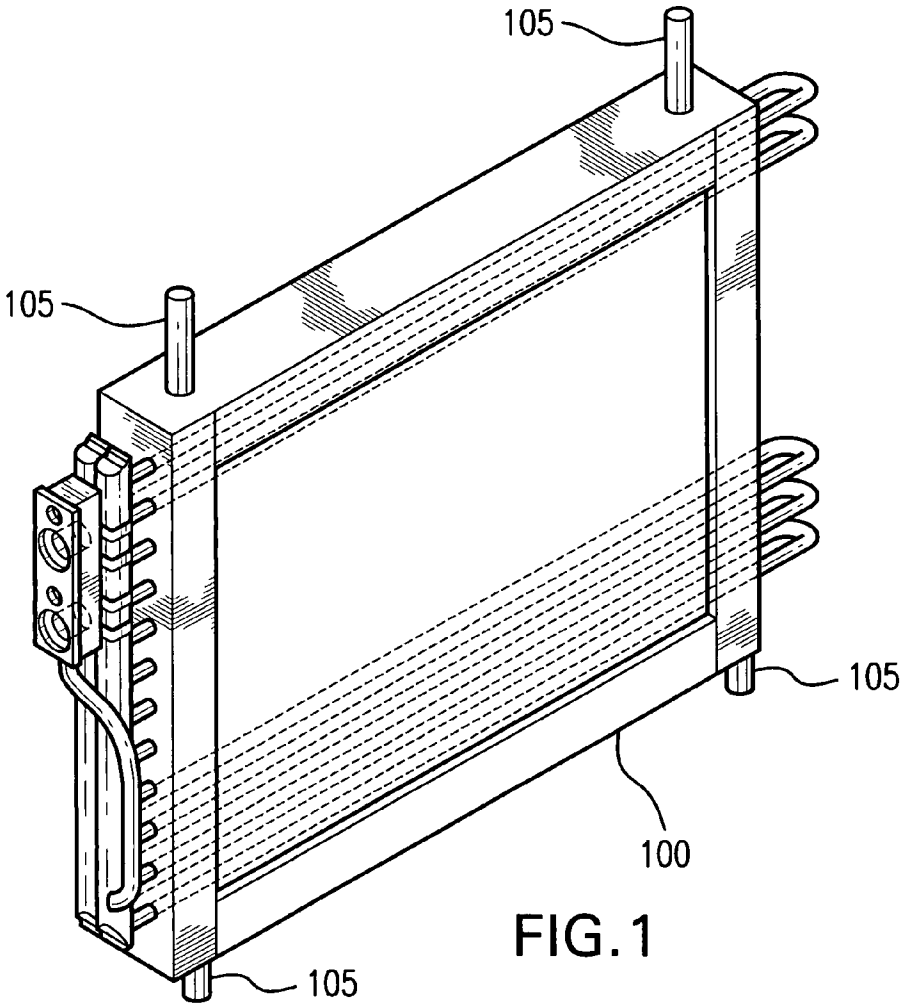
FIG. 1 illustrates a radiator having radiator pins according to an embodiment of the invention.

FIG. 1 illustrates a radiator 100 having radiator pins 105 according to an embodiment of the invention. As shown, the radiator 100 may be coupled to four radiator pins 105—one on the left-hand side of the top, one on the right-hand side of the top, one on the left-hand side of the bottom, and one on the right-hand side of the bottom of the radiator 100. The radiator pins 105 may be utilized to securely couple the radiator 100 to the engine compartment of an automobile or other device utilizing a radiator 100.

The radiator pins 105 may be formed of a metal such as aluminum coated with a clad material. The radiator 100 itself may also be formed of a metal such as aluminum. The radiator pins 105 and the radiator 100 may also have similar thicknesses. Accordingly, during a brazing process, the entire radiator assembly, including the radiator 100 and the radiator pins 105 may be brazed uniformly, while maximizing throughput. The brazing process may be uniform because when the radiator assembly is placed into a furnace, the entire assembly heats uniformly since the entire assembly is formed of a metal having a substantially uniform thickness (i.e., the entire assembly heats evenly).

Figure 2:
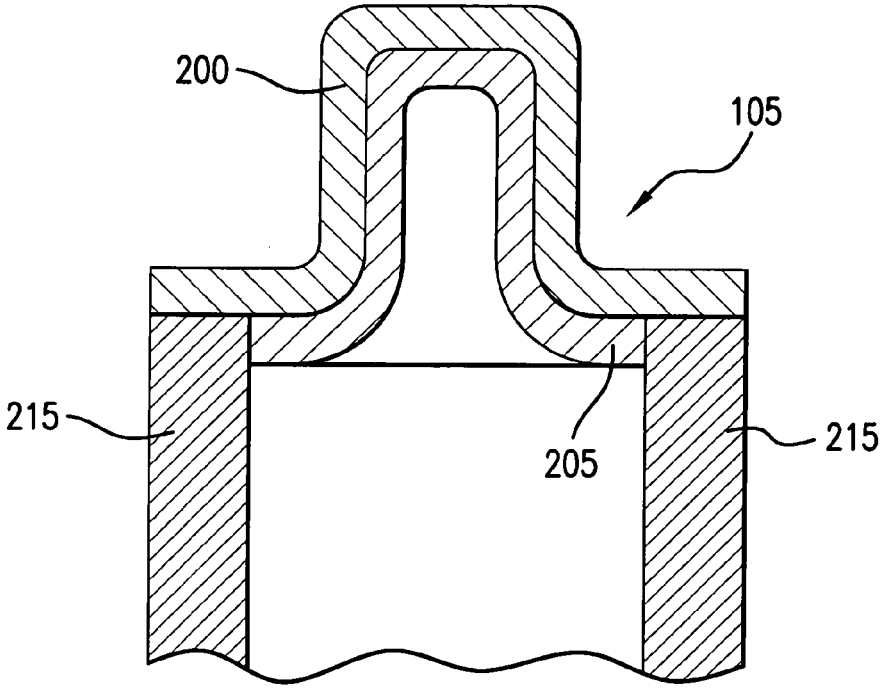
FIG. 2 illustrates a radiator pin according to an embodiment of the invention.

FIG. 2 illustrates a radiator pin 105 according to an embodiment of the invention. As shown, the radiator pin 105 includes an outer layer 200 and an inner layer 205. The outer layer 200 and/or the inner layer 205 may be coated with a clad material on the inside and/or outside edges. In other embodiments, rather than coating a clad material to the outer layer 200 and/or inner layer 205, the inner layer 205 and/or outer layer 200 may be formed directly of a clad alloy. The inner layer 205 may be coupled to the outer layer 200 via the clad material. The clad material may be heated during a brazing process, so that the inner layer 205 bonds securely to the outer layer 200. The inner layer 205 may serve as a sealing surface to the radiator header 215 (i.e., the radiator cap).

The outer layer 200 may serve as an attachment point to secure the radiator pin 105, and therefore the radiator 100 indirectly, to the automobile. The outer layer 200 may also serve a secondary function of also acting as a sealing surface for the radiator header 215. As illustrated, the outside edge of the inner layer 205 may be situated flush with the inner portion of the radiator header 215 near the top end. The bottom of the outer layer 200 may be situated flush with the top edge of the radiator header 215. During the brazing process, the entire pin 105 may be brazed to the header 215 at both the top end and the inner portion near the top end of the header 215.

Figure 3:
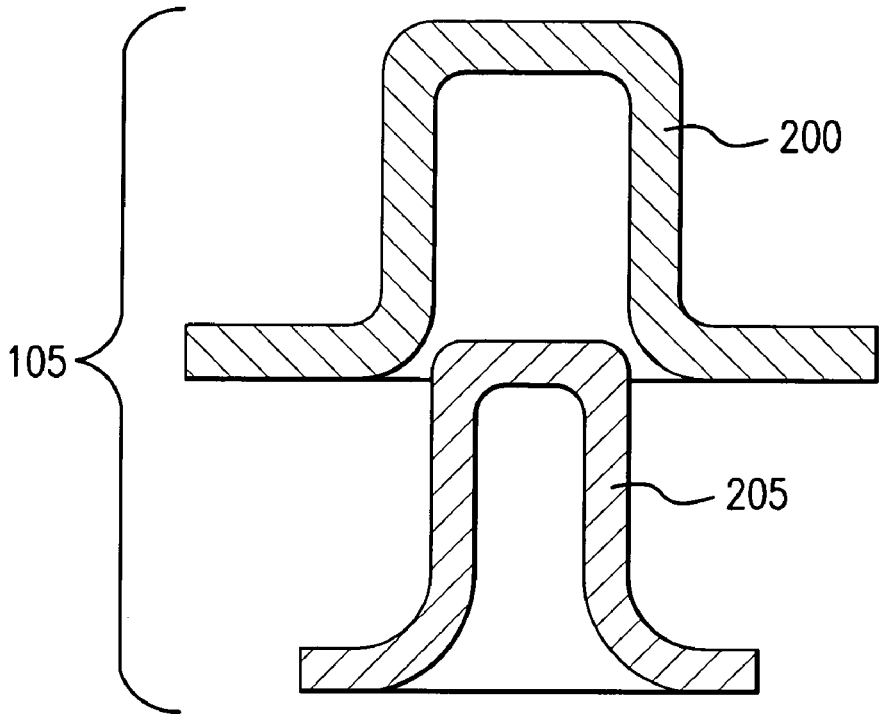
FIG. 3 illustrates an exploded view of a radiator pin according to an embodiment of the invention.

FIG. 3 illustrates an exploded view of a radiator pin 105 according to an embodiment of the invention. The outer layer 200 may be manually placed onto the inner layer 205. Each of the outer layer 200 and the inner layer 205 may be formed from sheet metal, such as aluminum coated with a clad material, via a stamping process. Alternatively, the inner layer 200 and the outer layer 205 may each be formed of any other manufacturing process which yields the correct shape. The outer layer 200 and/or inner layer 205 may each have their outside and/or inside coated with the clad material.

After the outer layer 200 is manually placed on top of the inner layer 205 to form the radiator pin 105, the radiator pin 105 may be positioned on the radiator header 215 of the radiator 100. The entire radiator assembly, including the radiator pin 105 and the radiator 100 may then be heated during a brazing process. During the brazing process, the clad material may melt, and when cooled, a secure bond may be formed between the outer layer 200 and the inner layer 205. As discussed above, the radiator pin 105 and the rest of the radiator 100 may be formed of the same, or a similar, metal so that the entire radiator assembly may be uniformly brazed during the brazing process.

Figure 4:
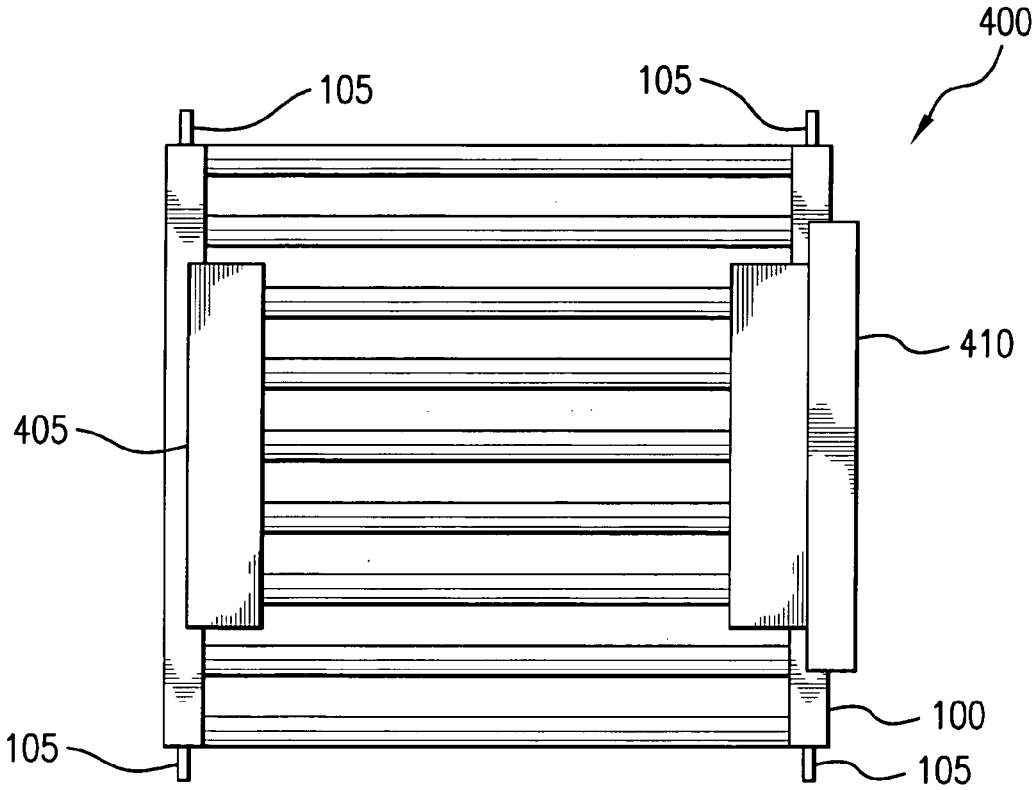
FIG. 4 illustrates a module having radiator pins according to an embodiment of the invention.

FIG. 4 illustrates a module 400 having radiator pins 105 according to an embodiment of the invention. The module 400 may include a radiator 100, a condenser 405, and a receiver/dryer 410. The module 400 may be much heavier than the radiator 100 itself. However, the module 400 may still be coupled to the engine compartment, or other device, within an automobile via the radiator pins 105.

Figure 5:
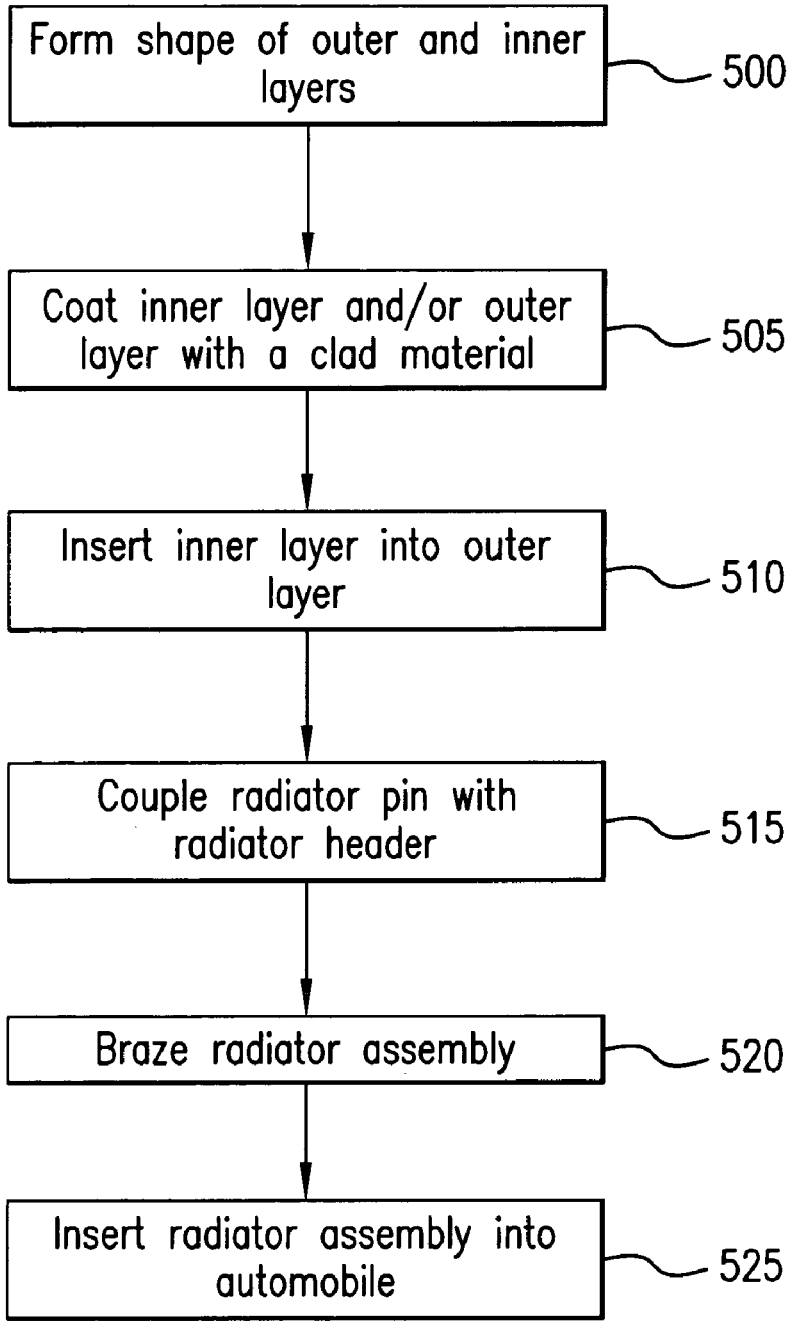
FIG. 5 illustrates a method of forming radiator pins and coupling a radiator to an automobile according to an embodiment of the invention.
Figure 6:
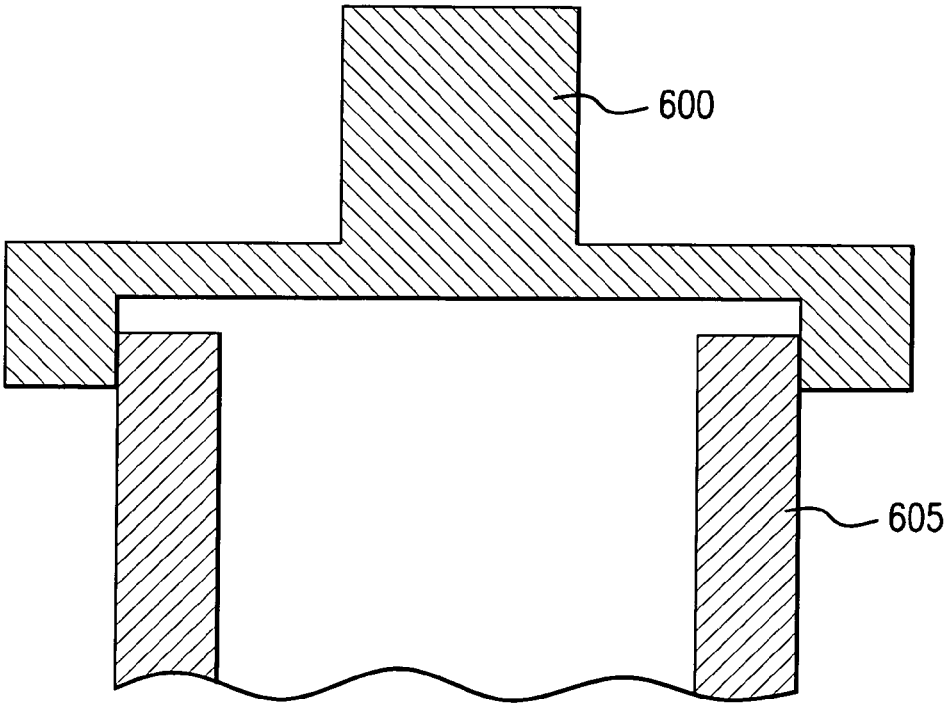
FIG.6 Prior Art
FIG. 6 illustrates a pin brazed to a radiator/condenser tube header according to the prior art.

FIG. 5 illustrates a method of forming radiator pins 105 and coupling a radiator 100 to an engine compartment of an automobile according to an embodiment of the invention. First, the shape of the inner layer 205 and the outer layer 200 may be formed 500. The inner layer 205 and the outer layer 200 may each be formed via a stamping process, or any other suitable manufacturing technique suitable to form the required shaped of the inner layer 205 and the outer layer 200. Next, the inner layer 205 and/or the outer layer 200 may be coated 505 with a clad material. Alternatively, each of the inner layer 205 and the outer layer 200 may be formed of a clad alloy, in which case there would be no need to further coat the inner layer 205 and/or the outer layer 200 with the clad material. The inner layer 205 may then be inserted 510 within the outer layer 200 to form a radiator pin 105.

The radiator pin 105 may then be coupled 515 to a radiator header 215 of a radiator 100 to form a radiator assembly. Next, the radiator assembly may undergo 520 a brazing process. During the brazing process, the inner layer 205 may become securely coupled to the outer layer 200 via the clad material. Finally, the radiator assembly may be inserted 525 into an automobile or other device for which the radiator assembly is to be used. The radiator assembly may coupled to an engine of an automobile, for example.

The inner layer 205 and the outer layer 200 of the radiator pin 105 may be formed of the same metal or other material as the rest of the radiator 100. Accordingly, in the event that the entire radiator assembly, including the radiator 100 and the radiator pins 105 needs to be recycled, the recycling process is simplified because the entire radiator assembly is formed of a common metal or other material.

The brazing process is also simplified. During a brazing process, the radiator assembly may be placed on a conveyor, which carries the radiator assembly through a furnace or other heat source. The radiator pin 105 and the radiator 100 may be formed of the same, or similar, material and may also have similar thicknesses. Accordingly, throughput may be maximized, because the radiator pin 105 may not appreciably slow the brazing process.

Moreover, because the inner layer 205 of the radiator pin 105 is not completely solid, the entire weight of the radiator assembly may be minimized, allowing an automobile to achieve greater fuel efficiency.

While the description above refers to particular embodiments of the present invention, it will be understood that many modifications may be made without departing from the spirit thereof. The accompanying claims are intended to cover such modifications as would fall within the true scope and spirit of the present invention. The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. A pin for a cooling system, comprising:

an inner layer formed of a first metal, the inner layer being hollow and being coupled to a header of the cooling system; and an outer layer formed of a second metal, the outer layer being coupled to the inner layer via a coupling material, wherein the coupling material is a clad material.

2. The pin of claim 1, wherein the cooling system is a radiator.

3. The pin of claim 1, wherein the cooling system is a condenser.

4. The pin of claim 1, wherein at least one of the first metal or the second metal is aluminum.

5. A pin for a cooling system, comprising:

an inner layer formed of a first metal, the inner layer being hollow and being coupled to a header of the cooling system; and an outer layer formed of a second metal, the outer layer being coupled to the inner layer via a coupling material, wherein outside edges of the inner layer are brazed to an inner surface of the header.

6. A pin for a cooling system, comprising:

an inner layer formed of a first metal, the inner layer being hollow and being coupled to a header of the cooling system; and an outer layer formed of a second metal, the outer layer being coupled to the inner layer via a coupling material, wherein a bottom edge of the outer layer is brazed to a top edge of the header.

7. A pin for a cooling system, comprising:

an inner layer formed of a first metal, the inner layer being hollow and being coupled to a header of the cooling system; and an outer layer formed of a second metal, the outer layer being coupled to the inner layer via a coupling material, wherein at least one of the first metal or the second metal is coated with a clad material.

8. A cooling assembly, comprising:

a cooling system to cool an automobile; and a pin to couple the cooling system to the automobile, the pin including an inner layer formed of a first metal, the inner layer being hollow and being coupled to a header of the cooling system, and an outer layer formed of a second metal, the outer layer being coupled to the inner layer via a coupling material, wherein the coupling material is a clad material.

9. The cooling assembly of claim 8, wherein at least one of the first metal or the second metal is aluminum.

10. The cooling assembly of claim 8, wherein the cooling system is formed of aluminum.

11. The cooling assembly of claim 8, wherein the cooling system is a radiator.

12. The cooling assembly of claim 8, wherein the cooling system is a condenser.

13. The cooling assembly of claim 8, wherein the pin couples the cooling system to an engine compartment of the automobile.

14. A cooling assembly, comprising:

a cooling system to cool an automobile; and a pin to couple the cooling system to the automobile, the pin including an inner layer formed of a first metal, the inner layer being hollow and being coupled to a header of the cooling system, and an outer layer formed of a second metal, the outer layer being coupled to the inner layer via a coupling material, wherein outside edges of the inner layer are brazed to an inner surface of the header.

15. A cooling assembly, comprising:

a cooling system to cool an automobile; and a pin to couple the cooling system to the automobile, the pin including an inner layer formed of a first metal, the inner layer being hollow and being coupled to a header of the cooling system, and an outer layer formed of a second metal, the outer layer being coupled to the inner layer via a coupling material, wherein a bottom edge of the outer layer is brazed to a top edge of the header.

16. A cooling assembly, comprising:

a cooling system to cool an automobile; and a pin to couple the cooling system to the automobile, the pin including an inner layer formed of a first metal, the inner layer being hollow and being coupled to a header of the cooling system, and an outer layer formed of a second metal, the outer layer being coupled to the inner layer via a coupling material, wherein at least one of the first metal or the second metal is coated with a clad material.

* * * * *